US006584940B1

(12) United States Patent
Khadkikar et al.

(10) Patent No.: US 6,584,940 B1
(45) Date of Patent: Jul. 1, 2003

(54) FLUE PIPE CONTROL

(75) Inventors: Prasad S. Khadkikar, Seville, OH (US); Richard L. Gerich, Mansfield, OH (US); Christine M. Hudson, Hudson, OH (US); Jeffrey A. West, Bellville, OH (US); Derek J. Rose, Mansfield, OH (US); Douglas J. Kempf, Mansfield, OH (US); Douglas E. Prather, Jackson, MI (US); Richard E. Welch, Lexington, OH (US)

(73) Assignee: Therm-O-Disc, Incorporated, Mansfield, OH (US)

( * ) Notice: Subject to any disclaimer, the term of this patent is extended or adjusted under 35 U.S.C. 154(b) by 0 days.

(21) Appl. No.: 10/042,984

(22) Filed: Jan. 9, 2002

(51) Int. Cl.[7] ..... F24H 1/40

(52) U.S. Cl. ..... 122/18.1; 122/18.31; 122/44.2; 122/155.2

(58) Field of Search ..... 122/18.1, 18.3, 122/18.31, 44.2, 155.2, 367.1, 367.2; 126/307 R, 312, 293; 165/102, 103, DIG. 119, DIG. 114, DIG. 116, DIG. 112

(56) References Cited

U.S. PATENT DOCUMENTS

| | | | | |
|---|---|---|---|---|
| 43,313 A | * | 6/1864 | Kellogg | 165/102 |
| 1,677,630 A | | 7/1928 | Haas et al. | |
| 1,773,585 A | | 8/1930 | Klockau | |
| 2,259,845 A | | 10/1941 | Valjean | |
| 3,921,900 A | | 11/1975 | Cole | |
| 3,976,245 A | | 8/1976 | Cole | |
| 4,076,171 A | | 2/1978 | Swenson | |
| 4,079,884 A | | 3/1978 | Sherman | |
| 4,136,676 A | | 1/1979 | McCown et al. | |
| 4,165,833 A | | 8/1979 | Nagel | |
| 4,182,483 A | | 1/1980 | Swenson | |
| 4,213,477 A | | 7/1980 | Velasquez | |
| 4,225,080 A | | 9/1980 | Barth | |
| 4,236,668 A | | 12/1980 | Prikkel, III | |
| 4,249,883 A | | 2/1981 | Woolfolk | |
| 4,251,024 A | | 2/1981 | Feinberg | |

(List continued on next page.)

OTHER PUBLICATIONS

G–Tech VAV–Boxes, 1997 G–Tech Products, Inc., pp. 1–5.
Energy Design Update, Jan. 1997, vol. 17, No. 1, pp. 1, 11 and 12.

(List continued on next page.)

*Primary Examiner*—Jiping Lu
(74) *Attorney, Agent, or Firm*—Harness, Dickey & Pierce, P.L.C.

(57) ABSTRACT

An improved flue pipe construction particularly adapted for a fuel fired water heater is disclosed which serves to reduce or minimize heat loss when the water heater is in a standby mode. The flue pipe construction comprises inner and outer concentric flue pipes which define an air space therebetween and one or more valve arrangements associated therewith to selectively restrict air flow through such air space. The valve arrangements include a thermally responsive actuator operative to open and close the valve member in response to heat generated by firing of the burner assembly without the need for any external power supply or interlocks.

24 Claims, 6 Drawing Sheets

U.S. PATENT DOCUMENTS

| | | | |
|---|---|---|---|
| 4,262,652 | A | 4/1981 | Butzen |
| 4,266,929 | A | 5/1981 | Swenson |
| 4,267,965 | A | 5/1981 | Everett |
| 4,289,271 | A | 9/1981 | Barth |
| 4,294,226 | A | 10/1981 | Feinberg |
| 4,299,554 | A | 11/1981 | Williams |
| RE30,936 | E | 5/1982 | Kmetz et al. |
| 4,372,485 | A | 2/1983 | McCabe |
| 4,384,671 | A | 5/1983 | Hayes |
| 4,386,731 | A | 6/1983 | Barth |
| 4,390,123 | A | 6/1983 | McCabe |
| 4,421,096 | A | 12/1983 | Butzen |
| 4,437,454 | A | 3/1984 | Hayes |
| 4,439,139 | A | 3/1984 | Nelson et al. |
| 4,441,653 | A | 4/1984 | Grudich |
| 4,460,121 | A | 7/1984 | Hedrick |
| 4,555,981 | A | 12/1985 | McCabe |
| 4,587,706 | A | 5/1986 | Prikkel, III et al. |
| 4,770,160 | A | 9/1988 | Schimmeyer |
| 4,919,329 | A | 4/1990 | McCabe |
| 4,953,510 | A | 9/1990 | Akkala et al. |
| 5,082,172 | A | 1/1992 | Karabin et al. |
| 5,186,385 | A | 2/1993 | Karabin et al. |
| 5,239,947 | A | 8/1993 | Schimmeyer |
| 5,345,963 | A | 9/1994 | Dietiker |
| 5,393,221 | A | 2/1995 | McNally |
| 5,447,125 | A | 9/1995 | McNally et al. |
| 5,695,116 | A | 12/1997 | Karabin |
| 5,732,692 | A | 3/1998 | Schimmeyer |
| 5,787,846 | A | 8/1998 | Schimmeyer |
| 5,845,632 | A | 12/1998 | Schimmeyer |

OTHER PUBLICATIONS

American National Standard/CSA Standard for Gas Water Heaters, ANSI Z21, 10.1–1998, vol. I, Storage Water Heaters With Input Ratings of 75,000 Btu Per Hour or Less, pp. 1, 23, 24, 25, 93, 94, 95, and 96.

American National Standard/CSA Standard For Gas Water Heaters, ANSI Z21.10.3–1998, vol. III, Storage Water Heaters With Input Ratings Above 75,000 Btu Per hour, Circulating and Instanteous, pp. 1, 23, 24, 95, 96, 97, and 98.

Specification sheets—Introduction, p. 2; Power Vented Gas Water Heater Parts List, p. 14; Installation, p. 8; (date unknown).

Appliance Manufacturer, Jan. 1997, p. 76: Supplier Spotlight, Robertshaw Controls, "Good things Come in Small Packages".

* cited by examiner

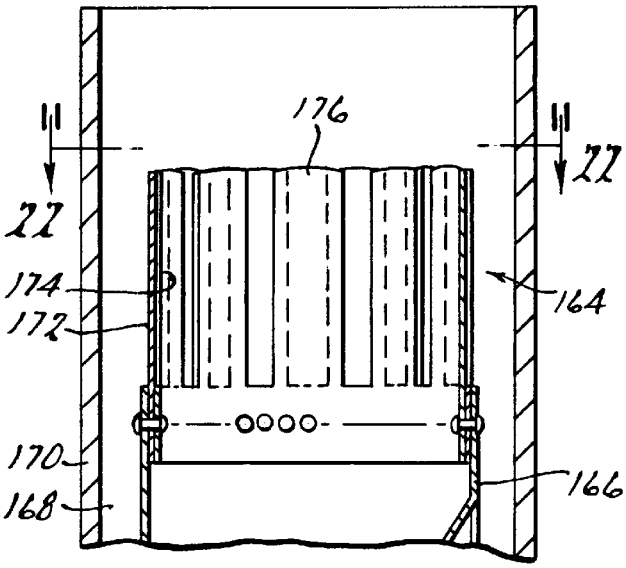
Fig. 21.
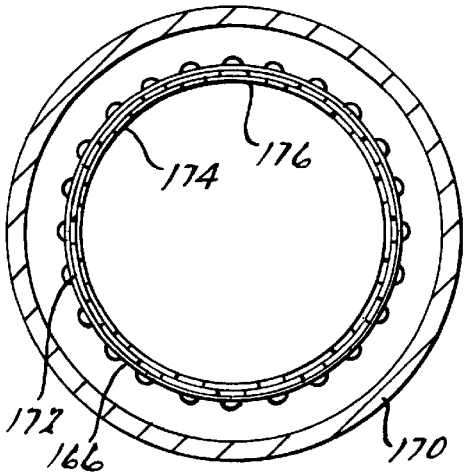
Fig. 22.
Fig. 23.
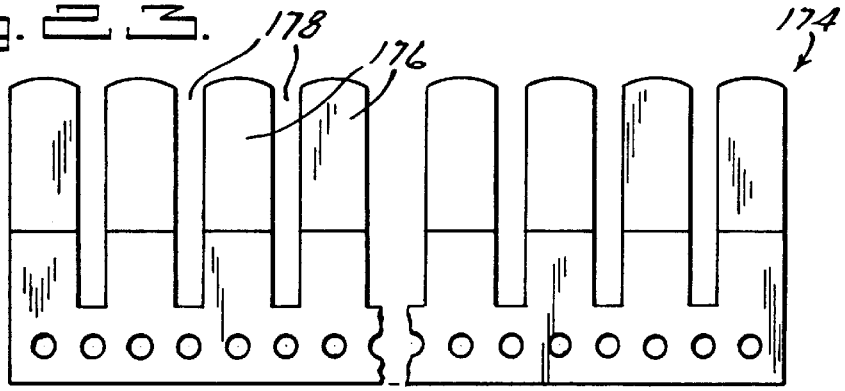
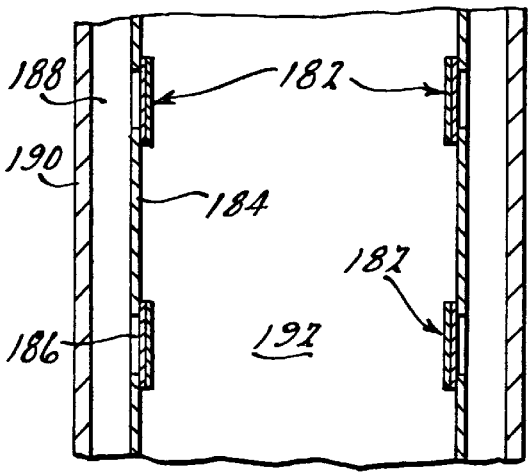
Fig. 24.
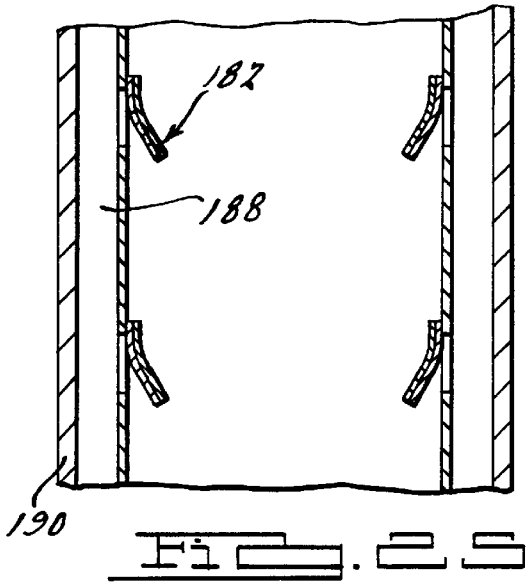
Fig. 25.

FLUE PIPE CONTROL

BACKGROUND AND SUMMARY OF THE INVENTION

The present invention relates generally to an improved flue pipe assembly particularly adapted for improving the efficiency of hot water heaters and more specifically to such apparatus which is designed to inhibit heat loss from the hot water within the water heater storage tank of a water heater.

Conventional gas fired water heaters in use today incorporate a center flue pipe which extends upwardly through the water storage tank and which is generally cylindrical in shape. Hot combustion gases from a gas fired burner assembly positioned below the water storage tank are directed upwardly through this center flue pipe which serves to transfer heat therefrom to the stored water surrounding the outer surface of the flue. In many cases the flue will include a device operative to induce turbulence into the flowing hot gases to improve heat transfer to the surrounding water. Such devices are commonly referred to as baffles and typically comprise an elongated zig zag or spiral shaped member suspended in the center of the flue. The combustion gases typically exit the top of the water heater and are directed out of the building within which the water heater is located via a vent or smoke pipe.

When the burner assembly is not firing, ambient air will flow through this flue pipe and cool the heated water in the storage tank thus reducing the overall efficiency of the water heater. In recent years increasing emphasis has been placed on improving the ability of such water heaters to efficiently heat the stored water and to reduce the heat loss therefrom when in a standby mode (i.e. burner assembly in an off condition) to thereby improve the overall operating efficiency.

Various types of insulation have been added to the outer surface of the water storage tank which have greatly reduced heat loss through these outer walls. Additionally, various types of damper arrangements have been incorporated into the external vent pipe to reduce air circulation through the flue pipe during standby periods. However, these damper arrangements generally require a power supply for operating same as well as safety interlocks to insure they are opened before the burner is fired. In some cases these devices may incorporate an arrangement that insures they are in an open position in the event of a power supply failure. Nevertheless, such devices are complex and costly to manufacture and because they require an external power supply, they also result in increased installation costs. Further, gas fired water heater manufacturers generally prefer to avoid the need for an external power supply for operation of their products. Additionally, because these devices are commonly incorporated in the external vent pipe and the internal flue pipe of the water heater is open to the surrounding environment via the vent hood, such dampers are not totally effective in preventing air flow through the flue pipe.

The present invention, however, overcomes the problems associated with the prior art devices by providing an effective insulating barrier between the wall of the flue and any air flow through the flue pipe thereby greatly reducing heat loss when the heater is in the standby mode while still ensuring good effective heat transfer through the flue pipe to the water when the water heater is firing. The primary objective of the present invention is to provide an arrangement which is highly efficient in transferring heat from the combustion gases to the water when the burner is firing but minimizes heat transfer from the water to gases flowing through the flue pipe when the water heater is in a standby mode.

In one embodiment an open cylindrical member of a diameter less than that of the flue pipe is positioned concentrically within the flue pipe and includes a plurality of openings in the sidewalls thereof with radially inwardly extending flanges positioned above the respective openings. A self powered thermally responsive valve assembly operates to selectively open and close the annular space between the inner cylindrical member and the flue pipe at the upper end thereof in response to firing of the burner assembly. Because the center of the cylindrical member is continuously in open communication with the water heater venting system there is no need for costly and complex interlocks with the burner control system. Further, the system does not require any external power supply for operation thus avoiding any increased installation expenses by the end user of the water heater.

In another embodiment, a similar valve assembly is also provided to open and close off the annular space between the cylindrical liner and flue pipe at the lower end thereof to further isolate the air volume in this annular space from convection air currents.

Each of these embodiments offer the advantage of effectively restricting heat loss from the heated water in the tank to air currents flowing through the center of the water heater while in a standby mode and yet also ensures good heat transfer to the tank water from the combustion gases when the burner is firing. For each case the path from burner assembly to the external venting system is continuously open thus eliminating the need for any complicated safety interlocks with the burner controls. Further because the system is self activating, there is no need for any external or auxiliary power supply which would increase installation costs or require periodic maintenance.

Additional advantages and features of the present invention will become apparent from the subsequent description and the appended claims taken in conjunction with the accompanying drawings.

BRIEF DESCRIPTION OF THE DRAWINGS

FIGS. 20 and 21 are fragmentary sectional views of another valving arrangement in accordance with the present invention with the valving arrangement shown in open and closed positions respectively;

FIG. 22 is a section view of the embodiment shown in FIGS. 20 and 21, the section being taken along lines 22—22 of FIG. 21;

FIG. 23 is an elevational view of a bimetallic valving member forming a part of the embodiment of FIGS. 20 and 21; and FIGS. 24 and 25 are enlarged fragmentary section views of yet another embodiment of the present invention with the valving shown in closed and open positions respectively.

DESCRIPTION OF THE PREFERRED EMBODIMENTS

Figure 1:
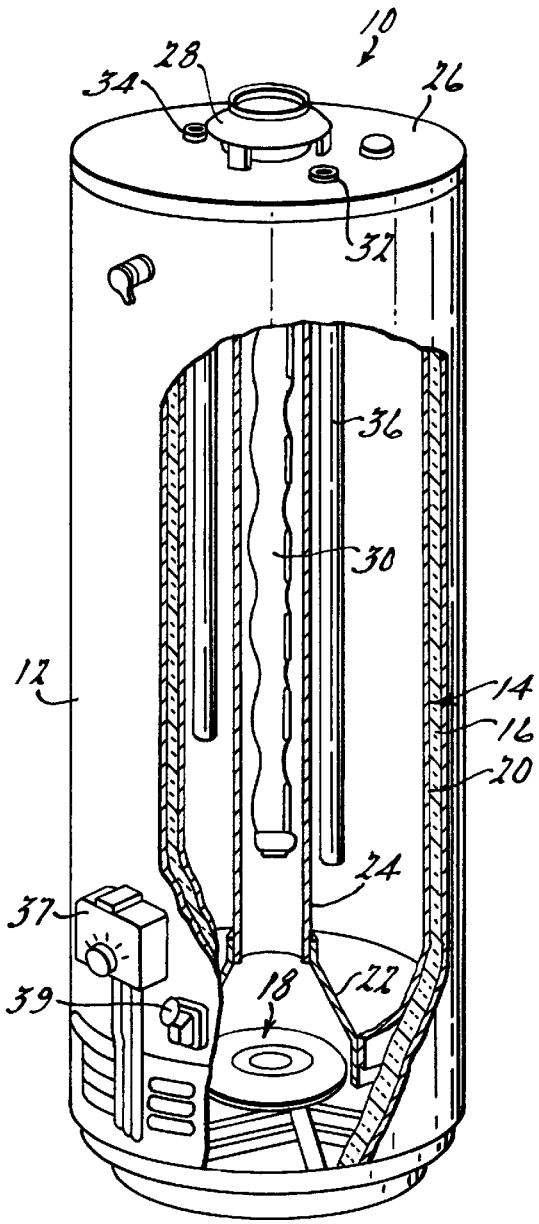
FIG. 1 is a perspective view of a conventional gas fired hot water heater with portions thereof broken away.

Referring now to the drawings and more specifically to FIG. 1, there is shown a conventional gas fired water heater indicated generally at 10. Water heater 10 includes an outer housing 12 within which is disposed a water storage tank 14 surrounded by a layer of insulation 16 and a gas fired burner assembly 18.

Water storage tank 14 has a generally elongated cylindrical shape, is positioned above burner assembly 18 and includes an outer shell 20, a generally conically shaped hood portion 22 sealingly secured to a lower portion of shell 20 and overlying the burner assembly and an axially elongated flue pipe 24 which is sealingly secured to hood portion 22 at its lower end and which projects outwardly through outer housing 12 at the upper end 26 thereof. Flue pipe 24 is connected to a smoke or vent pipe not shown via a draft hood 28. In operation, combustion gases generated by the firing of burner assembly 18 are directed upwardly through flue pipe 24 via hood 22 and serve to transfer heat to the water contained within storage tank 14. In many cases, a spirally shaped or zig zag baffle member 30 is supported within flue pipe 24 and serves to create a mixing of the combustion goods as they flow upwardly through flue pipe 24 to improve heat transfer to the water by reducing any thermal boundary layer that may form along the sidewalls of flue pipe 24.

Water heater 10 also includes suitable fittings 32 and 34 for connection to a supply of water and a water distribution system with water inlet 32 being provided with a dip tube 36 which serves to direct the inflow of cold water to the bottom of the tank 14.

Additionally, water heater 10 includes a control assembly 37 for controlling the supply of gas to burner assembly 18 in response to the sensed temperature of the water within tank 14. A drain spigot and valve assembly 39 is also provided for enabling the user of the water heater to periodically flush debris from the bottom of tank 14 as well as to drain same should this be desired.

As thus far described, water heater 10 is of a construction typical for gas water heaters currently in use.

As noted above, such water heaters are relatively efficient in transferring heat from the combustion process to the water within tank 14. Additionally, great care has been taken in the design of such systems to reduce heat loss to the environment through the outer walls of the tank 14. Such efforts include surrounding the outer wall 20 with insulating materials and minimizing the size and number of penetrations through such insulating material 16. However, the flue pipe 24 is in continuous open communication with the environment at both the upper and lower ends thereof. As a result, when the water heater is in the standby mode, air within flue pipe 24 will absorb heat from the hot water in tank 14 via flue pipe 24 and create a convection draft therethrough resulting in more frequent firing of the burning assembly to maintain the desired water temperature. The heat loss occasioned by this convection draft may result in a significant reduction in the overall operating efficiency of the water heater.

Figure 2:
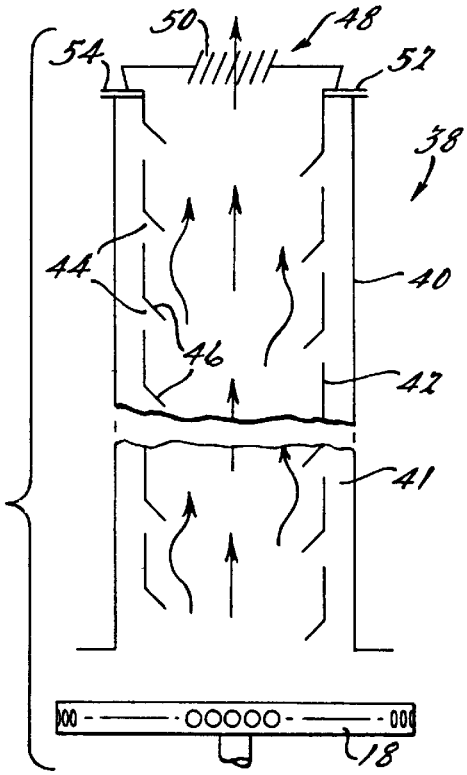
FIGS. 2 and 3 are schematic views of a portion of a flue pipe assembly for a water heater illustrating a preferred embodiment of the present invention in a standby mode and firing mode respectively.
Figure 3:
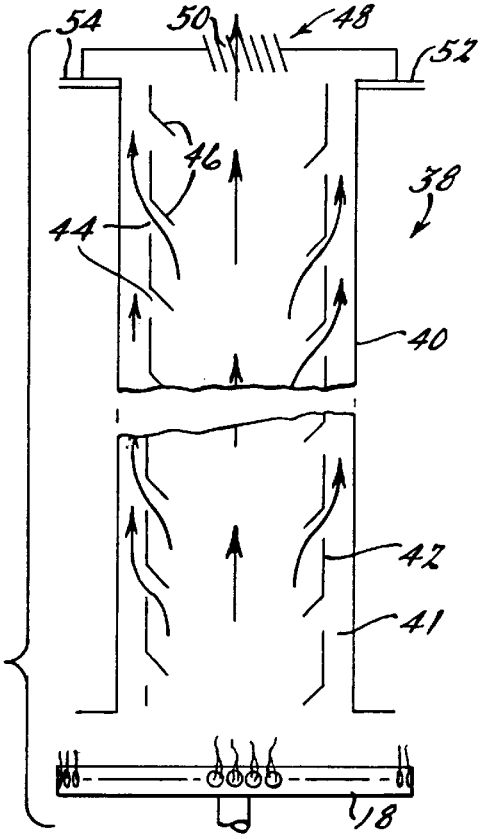

In order to minimize this convection draft heat loss while maintaining or perhaps even improving heat transfer to the water from the combustion gases, the present invention incorporates a modified flue pipe assembly 38 which, as shown in FIGS. 2 and 3, includes an elongated generally cylindrically shaped outer flue pipe 40 and a smaller diameter inner flue pipe 42 of substantially equal length. Inner flue pipe 42 is preferably supported concentrically within outer flue pipe 40 so as to define an annular space 41 therebetween and includes a plurality of circumferentially and axially spaced openings 44 therein. A louver 46 extends generally radially inwardly immediately above each of the openings 44 and is angled axially somewhat in a downward direction toward burner assembly 18. Annular space 41 is in open communication with the burner assembly 18 at its lower end and is closed off at the upper end of flue pipes 40 and 42 by a temperature responsive valve assembly 48. Valve assembly 48 includes a thermally responsive actuator 50 centrally positioned over the open upper end of inner flue pipe 42 and oppositely moveable valves 52 and 54. When burner assembly is in a standby mode (i.e. not firing), valve assembly 48 will be in a closed position effectively sealing off the upper end of the annular space 41 between inner and outer flue pipes 42 and 40. As a result, annular chamber 41 will effectively create a dead air space thereby insulating outer flue pipe 40 and the heated water radially outwardly thereof from air circulation through inner flue pipe 42. When burner assembly 18 is fired, the hot combustion gas will initially flow upwardly through inner flue pipe 42 and heat actuator 50 of valve assembly 48 which will operate to move valve members 52 and 54 into an open position thereby opening the upper end of chamber 41 and allowing flow of hot combustion gases into intimate contact with the inner surface of outer flue pipe 40. Heat from the combustion gases will then be transferred through outer flue pipe 40 to heat the water.

It is believed that the combination of the openings 44 in inner flue pipe 42 and the angled louvers 46 will cooperate to enhance flow of hot combustion gases into annular chamber 41 thereby enhancing heat transfer to the surrounding water when valve assembly 48 is in an open position. However, when the water heater is in a standby mode, it is believed that inner pipe 42 with louvers 46 will assist in reducing air circulation into and out of annular chamber 41 as well as reducing the air flow velocity therethrough thus enhancing the insulating effort of the "dead" air space provided between the two flue pipes. It should also be noted that because valve assembly 48 only closes off annular chamber 41, the entire area within inner flue pipe 42 is continuously open, to the vent system. Thus there is no need to provide any interlocks with the controls for burner assembly 18 because should valve assembly 48 fail to open on firing of burner 18, the hot combustion gases will still be vented via inner flue pipe 42. It should be noted that modeling analysis has indicated that the use of an inner flue pipe 42 without the inclusion of a valve assembly reduces the fluid flow velocity in the gap between the inner and outer flue pipes and thus reduces standby heat loss even without the inclusion of valve assembly 48.

Figure 4:
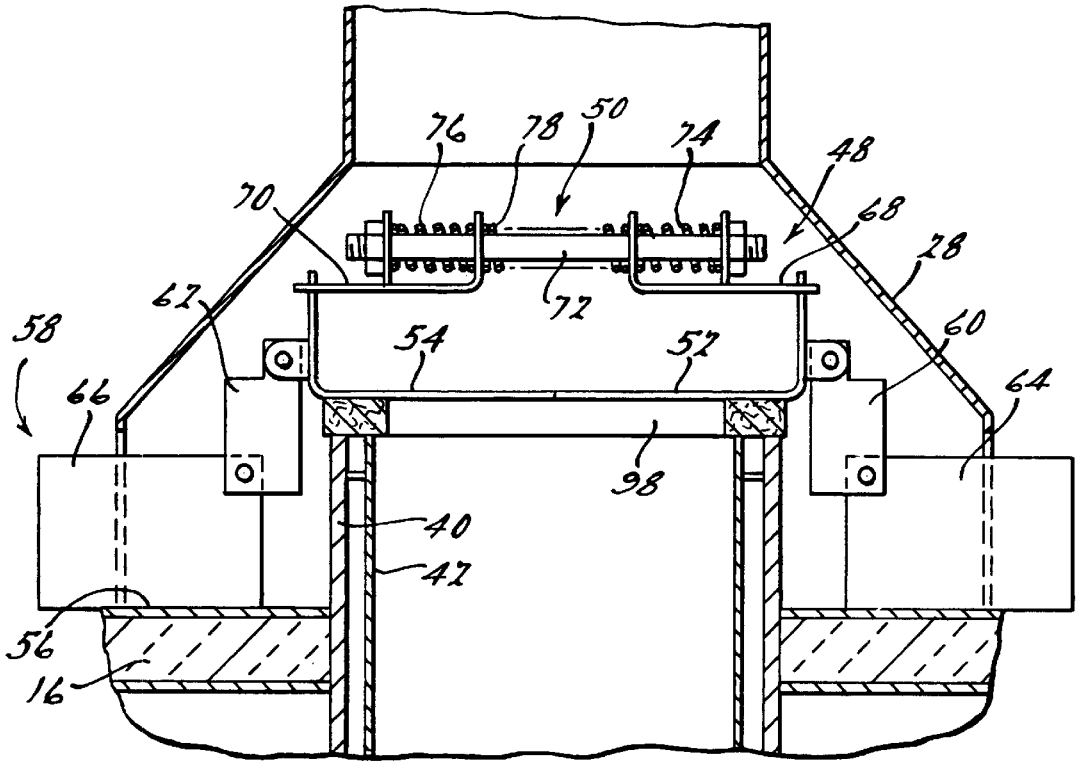
FIG. 4 is a fragmentary section view of an upper portion of a water heater incorporating the embodiment of FIGS. 2 and 3 and showing the valving arrangement utilized therein in a closed position, all in accordance with the present invention.
Figure 5:
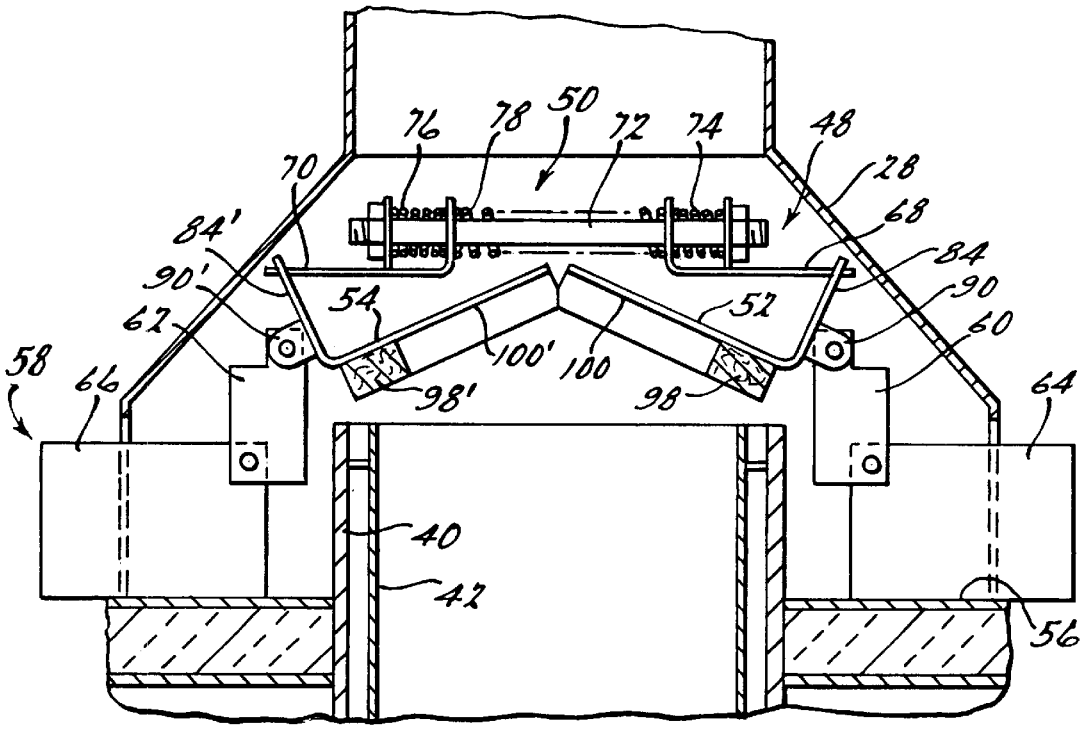
FIG. 5 is viewed similar to that of FIG. 4 but showing the valving arrangement in an open position.
Figure 6:
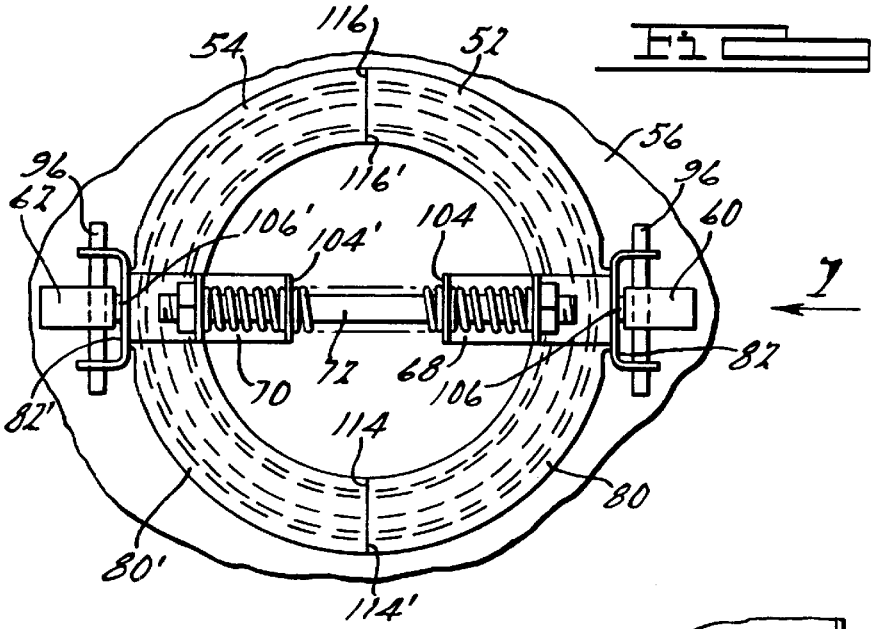
FIG. 6 is a plan view of the valving arrangement shown in FIG. 4.
Figure 7:
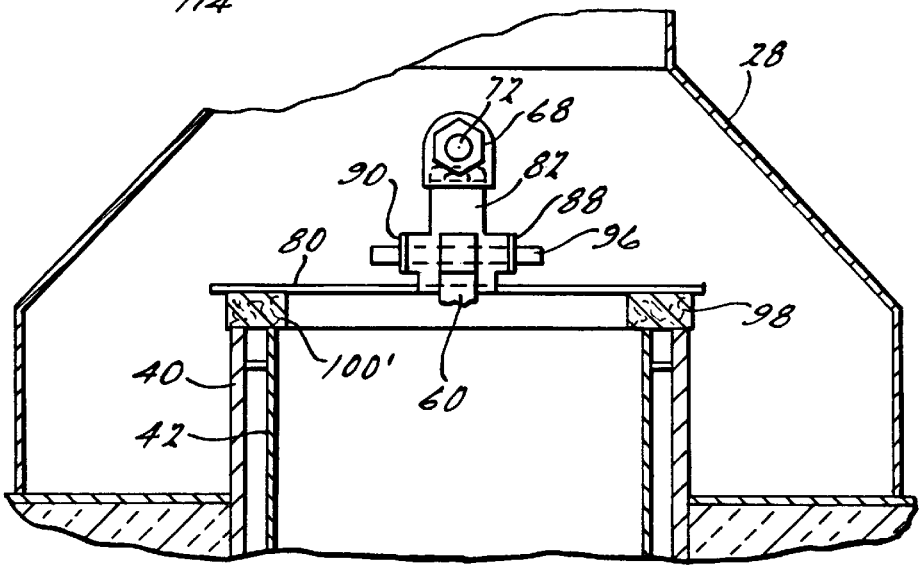
FIG. 7 is a view of the valve assembly of FIG. 6 as seen looking in the direction of arrow 7 and with portions of the water heater shown in section.
Figure 8:
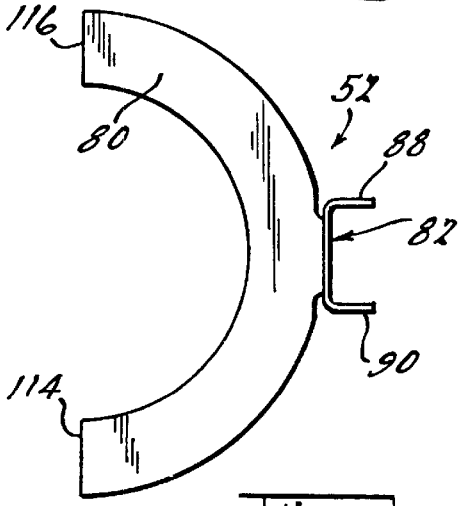
FIG. 8 is a plan view of one of the valve members incorporated in the valving arrangement of FIG. 6.
Figure 9:
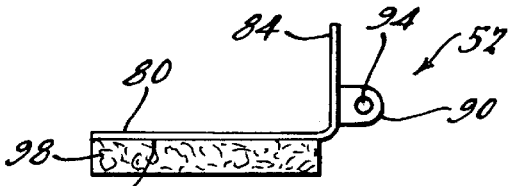
FIGS. 9 and 10 are elevational views of the valve member of FIG. 8, the respective views being taken at right angles to each other.
Figure 10:
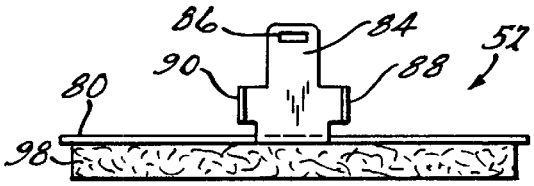

Thermally actuated valve assembly 48 is shown in greater detail and will be described with reference to FIGS. 4 through 15. With reference to FIGS. 4 and 5, valve assembly 48 includes a pair of valve members 52 and 54 pivotably supported on an upper surface 56 of hot water heater 58 via brackets 60 and 62 and suitable support members 64 and 66. Additionally thermal actuator 50 extends between valve 52 and 54 and includes a pair of actuator brackets 68 and 70 and an interconnecting rod 72 extending therebetween. A pair of compression springs 74 and 76 are provided on rod 72 adjacent opposite ends thereof and serve to bias brackets 68 and 70 toward each other. A center thermally responsive opening member 78 is also provided on rod 72 positioned between brackets 68 and 70 and acting in opposition to respective springs 74 and 76.

Valve members 52 and 54 are substantially identical in construction and hence only valve member 52 will be described in detail with corresponding portions of valve member 54 being indicated by the same reference numbers primed. As best seen with reference to FIGS. 6–10, valve member 52 includes a substantially planar semicircular portion 80 from which a supporting flange 82 extends upwardly from a location substantially equidistant from the opposite ends thereof. Supporting flange 82 includes an elongated center portion 84 having a laterally extending slot 86 positioned adjacent the upper end thereof and a pair of laterally spaced outwardly extending pivot flanges 88, 90 adjacent the planar portion 80. Aligned openings 94 are provided in respective pivot flanges 88 and 90 and are sized to receive a pivot pin 96 by which valve member 52 may be pivotably supported via bracket 60 and support member 64. A suitable heat resistant resilient sealing material 98 is suitably secured to lower surface 100 of planar portion 80 and is suitably sized so as to matably engage the upper edges of inner and outer flue pipes 40 and 42 when valve member 52 is in a closed position.

Actuator bracket 68 is also substantially identical to actuator bracket 70 and hence only bracket 68 will be described, it being understood that corresponding portions of bracket 70 will be indicated by the same reference numbers primed.

Figure 11:
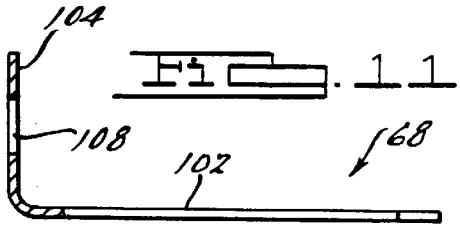
FIGS. 11, 12 and 13 are side, plan and front views respectively of an actuator bracket forming a part of the valve assembly of FIG. 6.
Figure 12:
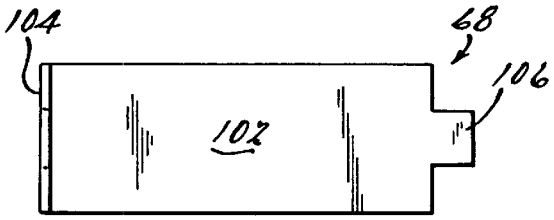
Figure 13:
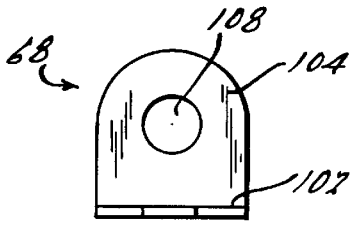

As best seen with reference to FIGS. 11, 12 and 13, actuator bracket 68 includes an elongated substantially planar portion 102 having an upstanding flange portion 104 provided at one end thereof. A reduced width tab portion 106 is provided at the opposite end of planar portion 102 from flange 104 and is adapted to be received within slot 86 of valve member 52. Preferably, tab 106 will have a width and thickness so as to be relatively loosely fitted within slot 86. Flange portion 104 includes an opening 108 therein suitably sized to slidingly receive rod 72 therethrough.

Figure 14:
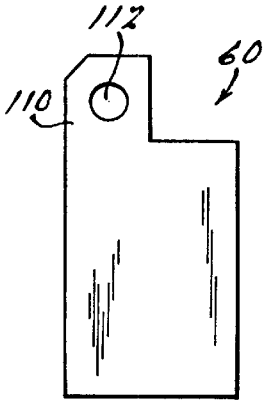
FIGS. 14 and 15 are side and plan views of a mounting bracket forming a part of the valve assembly of FIG. 6.
Figure 15:
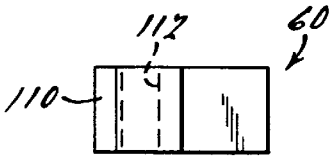

Bracket 60 is substantially identical to bracket 62 and hence only bracket 60 will be described in detail it being understood that corresponding portions of bracket 62 will be indicated by the same reference numbers primed. As shown in FIGS. 14 and 15, bracket 60 is generally rectangular in shape and includes an upstanding portion 110 through which bore 112 extends. Bore 112 is suitably sized to receive pivot pin 96 so as to thereby enable valve member 52 to be pivotably supported therefrom in cantilevered relationship. As noted above, bracket 60 is suitably fixedly supported on water heater 10 by a suitable support member 64 affixed to the upper surface 56 of water heater 10. Alternatively, bracket 60 may be directly secured to water heater 10 if desired.

Referring once again to FIGS. 4 through 7, valve members 52 and 54 are pivotably supported with opposite ends 114, 116 and 114', 116' of semicircular portion 80 in opposed relationship and sealing material 98, 98' provided thereon in sealing engagement with the upper end of flue pipes 40 and 42. Respective tabs 106, 106' of actuating brackets 68 and 70 are loosely received within respective slots 86, 86' of valve members 52 and 54 and interconnecting rod 70 extends through openings 108, 108' of upstanding flange portions 104, 104'. As noted above, flange portions 104, 104' are acted on opposite sides by respective compression springs 74 and 76 and thermally responsive opening member 78.

In operation, as thermally responsive opening member 78 is heated by combustion gas flowing upwardly through inner flue pipe 42, it will operate to exert oppositely directed forces on respective actuator brackets 68 and 70 thereby causing them to overcome the biasing forces of springs 74 and 76 and to move outwardly along rod 72. As actuator brackets 68 and 70 are biased outwardly along rod 72, the opposite ends thereof will operate against flange portion 82, 82' thereby causing respective valve members 52 and 54 to pivot about respective rods 96 and move sealing members 100, 100' out of engagement with flue pipes 40, 42 and open the upper end of chamber 41. Thereafter, the hot combustion gases will be directed through openings 44 into intimate heat transfer relationship with outer flue pipe 40 to heat the water within tank 14 and then exhausted via the open upper space between flue pipes 40, 42.

Once the water temperature has reached the preset temperature, controller 37 will shut down burner assembly 18 thereby discontinuing the supply of heat to thermally responsive opening member 78 and allowing same to cool. As thermally responsive opening member 78 cools and contracts, the biasing action of springs 74 and 76 will cause actuator brackets 68 and 70 to move along rod 72 toward each other thereby allowing valve members 52 and 54 to move into a closed position as shown in FIG. 4 in which convection draft air flow through annular chamber 41 is effectively resisted. The thus confined "dead" air space will then serve as an insulating layer against heat loss to air that may circulate through inner flue pipe 42.

In a presently preferred embodiment, it is contemplated that thermally responsive opening member 78 will be in the form of a helical coiled spring fabricated from a shape memory alloy material. Such materials are known in the art and exhibit the ability to rapidly change from a given shape to a "remembered" shape upon being heated to a predetermined temperature and to return to a deformed shape upon cooling below the predetermined temperature. In the particular embodiment described, the "remembered" shape would be a longer helical coil and the "deformed shaped" would be a shortened helical coil.

It should be noted that because thermally responsive opening member 78 is centrally disposed above the open inner flue pipe 42 it will be immediately subjected to heating by the combustion gases upon firing of burner assembly 18 and will thus be quickly responsive to same to open valve members 52 and 54. Further, because the center of inner flue pipe 42 is continuously open to the vent system, combustion gas will always be free to flow to and through the associated vent system and exhausted to the outside even in the event valve assembly 48 should fail to open. Thus, it is not necessary to incorporate any interlock system between valve assembly 48 and control 37 although this could be done if desired. It should also be noted that while a shape memory alloy material is presently preferred, other types of thermally responsive opening devices could be substituted therefor, the only requirements being that the device be capable of generating a sufficient force to move valve members from a closed position to an open position in response to an increase in temperature thereof.

Figure 16:
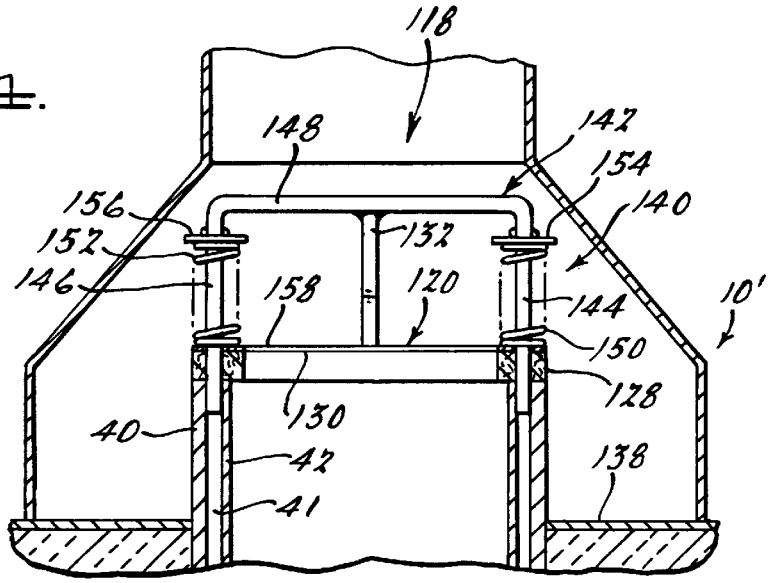
FIG. 16 is a view similar to that of FIG. 4 but showing an alternative valving assembly in accordance with the present invention.
Figure 17:
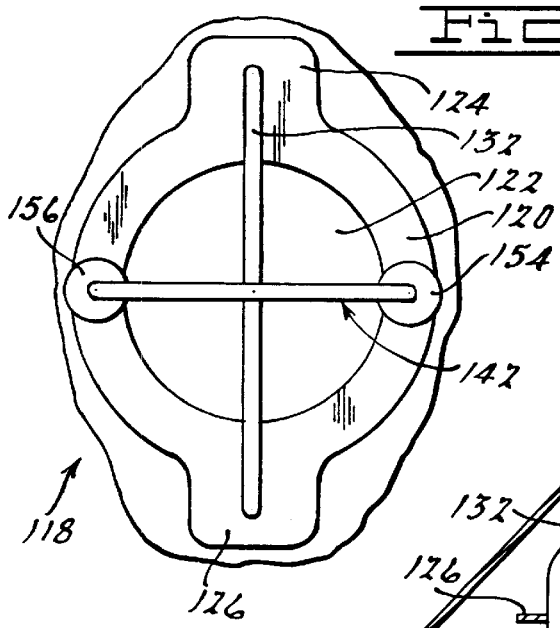
FIG. 17 is a plan view of the valving assembly of FIG. 16.
Figure 18:
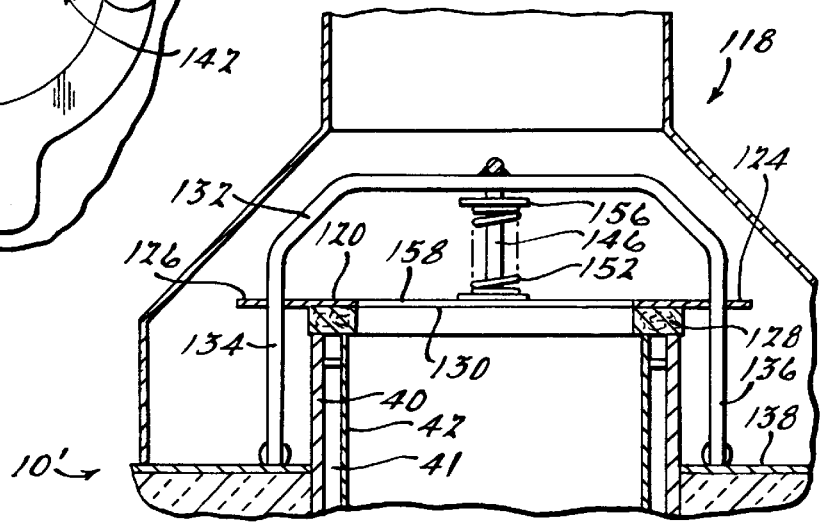
FIG. 18 is a view similar to that of FIG. 16 but showing the valving assembly rotated by 90°.

Referring now to FIGS. 16–18, there is shown another embodiment of a valve assembly 118 in accordance with the present invention. In this embodiment, valve assembly 118 comprises a valve member 120 in the form of an annular ring having an open center portion 122 aligned with the open center of inner flue pipe 42 and a pair of diametrically opposed radially outwardly projecting extensions 124, 126. A suitable heat resilient sealing material 128 is secured to the lower surface 130 of valve member 120 and serves to sealingly engage the upper ends of inner and outer flue pipes 40, 42 in the same manner as material 98 when valve member 120 is in a closed position.

In order to retain valve member 120 in position with respect to inner and outer flue pipes 40 and 42, as well as to guide opening and closing movement thereof, an elongated generally U-shaped guide member 132 is provided which includes a pair of leg portions 134, 136 extending through suitable openings provided in respective extensions 124, 126 with the terminal ends thereof being secured to upper surface 138 of hot water heater 10'.

An actuator assembly 140 is also provided which includes a second generally U-shaped elongated member 142 having a pair of leg portions 144, 146 and an interconnecting portion 148. As shown, member 142 is positioned substantially perpendicular to member 132 with interconnecting portion 148 being affixed to member 132 at the point of intersection. Legs 144 and 146 each project through valve member 120 and are secured to outer flue pipe 40. A pair of thermally responsive opening members 150, 152 are provided on leg members 144, 146 each having one end fixedly secured to an annular flange member 154, 156 each of which are in turn fixedly secured to respective leg portions 144 146 adjacent the upper end thereof. The opposite ends of thermally responsive opening member 150,152 are secured to the upper surface 158 of valve member 120.

In operation, when burner assembly 18 is fired, the hot combustion gas flowing through inner flue pipe 42 will operate to heat thermally responsive opening members 150, 152. Once the temperature of thermally responsive opening member 150, 152 exceeds a predetermined temperature, they will contract thereby lifting valve member 120 upwardly away from inner and outer flue pipes 40, 42 and allowing the hot combustion gases to flow through annular chamber 41 in the same manner as described with respect to valve assembly 48. When burner assembly 18 is shut down, thermally responsive opening members 150, 152 will cool and thus return to their elongated state thereby moving valve member into a closed position as shown.

Preferably, as with valve assembly 48, thermally responsive opening members 150, 152 will be in the form of helical coils of shape memory alloy material although in this embodiment, the "remembered" hot shape will be a shorter helical coil. Again, it should be noted that other devices having the ability to move valve member 120 upwardly in response to an increased temperature may be substituted therefor.

Figure 19:
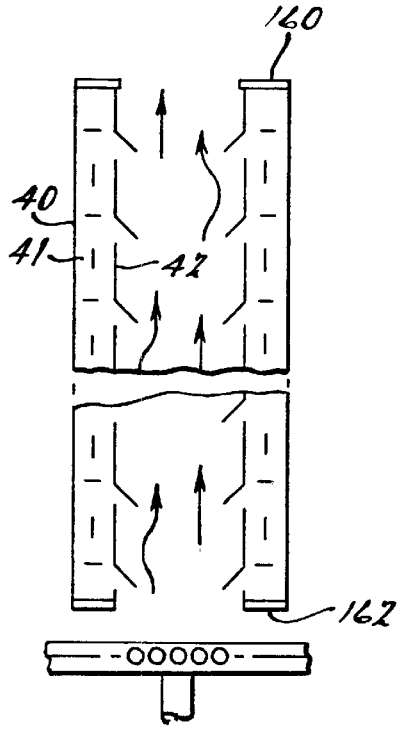
FIG. 19 is a view similar to that of FIG. 2 but showing the inclusion of a second thermally actuated valve at the lower ends of the inner and outer flue pipes.

While the above embodiments have been described with the use of only a single thermally responsive valve assembly positioned at the upper end of flue pipes 40, 42, it may in some applications be desirable to incorporate a second valve assembly at the lower end of flue pipes 40, 42. Such an embodiment is illustrated schematically in FIG. 19 in which both upper 160 and lower 162 valve assemblies are incorporated to close off annular space 41 between inner and outer flue pipes 40, 42 during the standby mode. Either valve assemblies 48 or 118 may be used for either of valve assemblies 160, 162 or alternatively one or both may be of the type described below with reference to FIGS. 20 and 21. Further, if desired, a single valve assembly may be provided at the lower end of flue pipes 40, 42.

FIGS. 20–23 illustrate yet another embodiment of the present invention. In this embodiment, a valve assembly 164 is secured to the upper end of inner flue pipe 166 and operates to selectively open and close off the annular area 168 between inner and outer flue pipes 166 and 170. Valve assembly 164 comprises first and second substantially identical elongated bimetal strips 172, 174 each of which includes a plurality of upwardly projecting fingers 176 separated by notches 178 extending laterally inwardly from the upper edge thereof. As shown, the lower edges of first and second strips 172 and 174 are secured to the upper edge of inner flue pipe 166 in any suitable manner such as by a plurality of circumferentially spaced rivets 180. Preferably, second strip 174 is circumferentially offset from first strip 172 such that fingers 176 of one strip overlie notches 178 of the other strip. Strips 172 and 174 are fabricated from a suitable bimetal material having the ability to resist the by-products of combustion contained in the combustion gases passing through flues 166, 170.

When the water heater is in a standby mode, the ends of fingers 176 will extend axially and radially outwardly into engagement with outer flue 170. The overlapping arrangement of the respective fingers and notches 176, 178 will enable the bimetal strips to effectively close off the upper end of annular space 168 thereby resisting cooling convection gas currents and reducing the resulting standby heat loss. When the water heater burner assembly is actuated, the hot combustion gases traveling through the flue pipe will heat respective first and second bimetal strips 172, 174 and, as a result of the differential in the coefficient of expansion between the layers of the bimetal strips, fingers 176 will move radially inwardly to the position shown in FIG. 21 thereby opening the upper end of annular space 168 thus enabling the flow of gases therethrough.

Figure 20:
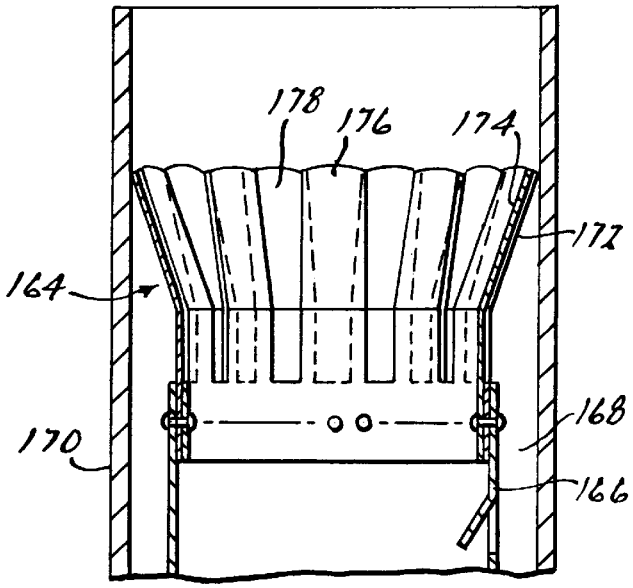

Once the water has been heated to the desired temperature, the water heater burner assembly will be shut down and bimetal strips 172, 174 will cool thus causing fingers to return to the closed position as shown in FIG. 20. It should be noted that strips 172 and 174 may alternatively be fabricated from a shape memory alloy if desired.

Referring now to FIG. 24, a further embodiment of the present invention is shown. This embodiment is similar to that of FIGS. 2 and 3 with the exception that fixed louvers 46 have been replaced with thermally actuable louvers 182. As shown, louvers 182 are preferably fabricated from a suitable bimetal material and are secured to inner flue pipe 184 in overlying relationship to respective openings 186 provided therein thus closing off communication between annular space 188 disposed between inner and outer flue pipes 184, 190 and the open interior space 192 defined by inner flue pipe 184 when the water heater is in a standby mode. When the burner assembly fires, the hot combustion gases traveling through space 192 will heat bimetal valves 182 in response to which they will move into a position similar to that of louvers 46 shown in FIGS. 2 and 3. Upon a return of the burner assembly to a standby mode, bimetal valves 182 will cool and return to their respective closed positions as shown in FIG. 24.

It should be noted that while it is believed preferable to utilize one of the valve assemblies described above to close off the upper and/or lower openings between inner and outer flue pipes 184 and 190 in combination with valves 182, valve assemblies 182 could be used alone although it is believed the resulting improvements in operating efficiency for the water heater will not be as great. Also, as mentioned above, valves 182 may be fabricated from a shape memory alloy in lieu of a bimetal material if desired.

It should be noted that with respect to all of the embodiments above, the diameter of inner flue pipe 42, 166, 184 must be selected relative to the size of the burner assembly so as to provide adequate flue area for proper venting of the combustion gases. Further, the number and positioning of the louvers should be such that they do not prevent the proper venting of the combustion gases even when the valve assembly is in a closed position. Also the number and positioning of the openings 44, 186 as well as the shape and angulation of the louvers and the spacing between the inner and outer flue pipes 40, 42; 166, 170; 184, 190 will be selected so as to maximize the heat transfer to the surrounding water when burner assembly 18 is being fired and yet minimize the cooling effect of convection drafts on the heated water while the water heater is in a standby mode.

As may now be appreciated, the present invention provides a relatively inexpensive easily fabricated flue pipe assembly which is highly effective in reducing standby heat losses for water heaters. Because the present invention enables full flow of combustion gas even when the valve assemblies are in a closed position, no interlocks are required. Further, the present invention achieves these objectives without requiring any additional external connections upon installation of the water heater such as for auxiliary power.

While it will be apparent that the preferred embodiment of the invention disclosed is well calculated to provide the advantages and features above stated, it will be appreciated that the invention is susceptible to modification, variation and change without departing from the proper scope or fair meaning of the subjoined claims.

We claim:

1. An improved flue pipe assembly for selectively promoting and inhibiting heat transfer between a fluid flowing through the interior of a flue pipe and a fluid surrounding the exterior of said flue pipe, said flue pipe assembly comprising:

a generally elongated flue pipe having an inner surface and an outer surface, said flue pipe being adapted to conduct a flow of a first fluid through the interior thereof, and a second fluid surrounding said outer surface and being in heat transfer relationship therewith; and apparatus within said flue pipe for selectively promoting and inhibiting heat transfer between said first fluid and said second fluid through said flue pipe.

2. A flue pipe assembly as set forth in claim 1 wherein said apparatus operates to promote heat transfer from said first fluid to said second fluid and to inhibit heat transfer from said second fluid to said first fluid.

3. A flue pipe assembly as set forth in claim 1 wherein said apparatus is operative to provide an insulating layer along said inner surface when said first fluid is below a predetermined temperature to inhibit heat transfer from said second fluid to said first fluid.

4. A flue pipe assembly as set forth in claim 3 wherein said insulating layer comprises a substantially non-flowing layer of said first fluid.

5. A flue pipe assembly as set forth in claim 4 wherein said apparatus includes an inner flue pipe supported within said elongated flue pipe and spaced therefrom to define an annular flow path therebetween and a valve assembly selectively operable to allow and inhibit flow of said first fluid through said annular flow path.

6. A flue pipe assembly as set forth in claim 5 wherein said valve assembly is self powered.

7. A flue pipe assembly as set forth in claim 1 wherein said valve assembly is thermally actuated from a closed position in which flow of said first fluid through said annular flow path is inhibited to an open position to allow flow of said first fluid through said annular flow path.

8. A flue pipe assembly as set forth in claim 7 wherein said valve assembly is actuated to said open position in response to an increase in the temperature of said first fluid.

9. A flue pipe assembly as set forth in claim 8 wherein said valve assembly is located at one end of said flue assembly.

10. An improved flue pipe assembly for effecting heat transfer from a first fluid flowing through an interior of said flue pipe assembly to a second fluid surrounding an outer surface of said flue pipe assembly and for resisting heat transfer from said second fluid to said first fluid, said flue pipe assembly comprising:

a first outer flue pipe having an inner surface and an outer surface, said outer surface being adapted to be in contact with said second fluid;

a second inner flue pipe positioned within said first flue pipe and having an inner surface defining an interior space adapted to allow flow of said first fluid therethrough and an outer surface positioned in spaced opposed relationship to said inner surface of said first flue pipe to define a fluid flow space therebetween; and a valve assembly associated with said flue pipe assembly, said valve assembly being movable between a first open position in which said first fluid may flow through said fluid flow space and a second closed position in which fluid flow through said fluid flow space is restricted.

11. A flue pipe assembly as set forth in claim 10 wherein said valve assembly is self powered to move between said open and closed position.

12. A flue pipe assembly as set forth in claim 11 wherein said valve assembly includes a thermally responsive actuator, said actuator being operable to move said valve assembly to said open position in response to an increase in the temperature of said first fluid above a predetermined temperature.

13. A flue pipe assembly as set forth in claim 10 wherein said inner flue pipe includes a plurality of spaced openings therein whereby said first fluid may flow from said interior space into said fluid flow space when said valve assembly is in said open position.

14. A flue pipe assembly as set forth in claim 13 further comprising a flange member projecting into said interior space adjacent at least some of said openings.

15. A flue pipe assembly as set forth in claim 14 wherein said flange member projects at an angle into the direction of flow of said first fluid.

16. A flue pipe assembly as set forth in claim 10 wherein said valve assembly is positioned adjacent one end of said flue pipe assembly.

17. A flue pipe assembly as set forth in claim 16 further comprising a second valve assembly positioned adjacent the other end of said fluid pipe assembly.

18. A flue pipe assembly as set forth in claim 16 wherein said valve assembly includes a valve member movable into and out of engagement with said inner and outer flue pipe.

19. A flue pipe assembly as set forth in claim 18 wherein said valve member is pivotably supported adjacent said outer flue pipe.

20. A flue pipe as set forth in claim 10 wherein said valve assembly includes a thermally responsive actuation assembly.

21. A flue pipe as set forth in claim 20 wherein said thermal actuator assembly includes a thermally responsive member positioned in overlying relationship to said interior space and operative to open said valve assembly in response to a temperature of said first fluid in excess of a predetermined temperature.

22. A flue pipe as set forth in claim 21 wherein said thermally responsive member is made from a shape memory alloy.

23. An improved flue pipe assembly for use in a fuel fired hot water heater comprising:

an outer flue pipe adapted to form part of a reservoir of water to be heated by said water heater and having one end adapted to be positioned in overlying spaced relationship to a burner assembly of said water heater;

an inner flue pipe positioned within said outer flue pipe and cooperating therewith to define an annular space between said inner and outer flue pipes, said annular space being open at opposite ends of said inner flue pipe;

at least one opening adjacent said one end of said flue pipe assembly, said opening being adapted to allow combustion gases from said burner assembly to flow into said annular space; and a valve assembly positioned adjacent the other end of said flue pipe assembly, said valve assembly being operative to selectively open and close said open annular space at said other end of said flue pipe assembly to thereby resist air flow through said annular space when said burner assembly is in a standby mode.

24. A flue pipe assembly as set forth in claim 23 wherein said valve assembly includes a thermally responsive actuator operative to open said valve assembly in response to heat generated by said burner assembly.

* * * * *

UNITED STATES PATENT AND TRADEMARK OFFICE

CERTIFICATE OF CORRECTION

PATENT NO. : 6,584,940 B1 
DATED : July 1, 2003
INVENTOR(S) : Prasad S. Khadkikar et al.

It is certified that error appears in the above-identified patent and that said Letters Patent is hereby corrected as shown below:

Column 10,
Line 20, "1" should be -- 5 --.

Signed and Sealed this

Ninth Day of December, 2003

JAMES E. ROGAN
*Director of the United States Patent and Trademark Office*